US006067812A

United States Patent [19]

Bushnell et al.

[11] Patent Number: 6,067,812

[45] Date of Patent: May 30, 2000

[54] CONDENSER FAN WITH CONDENSATE SLINGER

[75] Inventors: Peter R. Bushnell, Cazenovia; David M. Rockwell, Fayetteville, both of N.Y.

[73] Assignee: Carrier Corporation, Syracuse, N.Y.

[21] Appl. No.: 08/968,591

[22] Filed: Nov. 13, 1997

[51] Int. Cl.[7] ..... F25B 40/02

[52] U.S. Cl. ..... 62/280; 62/279

[58] Field of Search ..... 62/279, 280, 282, 62/285, 291

[56] References Cited

U.S. PATENT DOCUMENTS 2,825,540 3/1958 Merz et al. ..... 62/280

2,896,860 7/1959 Eberhart ..... 62/280

*Primary Examiner*—Henry Bennett

[57] ABSTRACT

A rotating shroud is located on the suction side of the tips of a propeller fan and coacts with an inlet orifice to provide the physical separation between suction and discharge when the unit is in operation. The pressure differential across the fan tends to cause the condensate to move towards the suction side and into the path of the slinger (rotating shroud). The slinger then becomes wetted by the condensate, thereby picking up the condensate and slinging it into the region between the fan and the coil. The condensate is then evaporated upstream or within the coil, improving coil effectiveness.

17 Claims, 4 Drawing Sheets

CONDENSER FAN WITH CONDENSATE SLINGER

BACKGROUND OF THE INVENTION

In air conditioning systems, condensation normally collects on the evaporator coil, runs off and has to be disposed of. In some units it is possible to dispose of the condensate via a drain or the like. In other units, such as room air conditioners, it is common to direct the condensate to the condenser side for automatic disposal and for improved condenser capacity and energy efficiency rating (EER) improvement. Common condensate distribution schemes include vortex impellers or aspirators, slingers, pumps and fan blade tips impinging the condensate. In window room air conditioners (WRACs) and packaged terminal air conditioners (PTACs), it is most common to use a slinger arrangement associated with the condenser fan. In a typical slinger arrangement a blow-through propeller fan coil configuration is used and the condensate collects at a location where the fan structure causes the condensate to be splashed onto the condenser coil where it is evaporated thereby, providing cooling to the condenser. A conventional slinger is located at the fan blade tips on the discharge (high pressure) side of the fan.

As applied to room air conditioners, prior art designs which incorporate slinger rings on the discharge side of the condenser fan are both noisy and inefficient. In these slinger designs, the high pressure on the discharge side of the fan drives the condensate towards the fan inlet, out of the path of the slinger, thereby limiting the effectiveness of the design. There is a tendency for pulsation of the condensate flow due to fluctuations in the condensate level. Further, the discharge slinger constrains the diffusion of air flow thereby reducing the aerodynamic performance of the fan. These prior art designs often have problems with splash out at the orifice inlet.

SUMMARY OF THE INVENTION

The present invention incorporates a partial rotating shroud onto the axial condenser fan to support a slinger ring on the inlet of the fan. The open blade tips on the discharge side of the fan allows the flow to shift radially within the fan due to the presence of the downstream coil thereby making the fan quiet and efficient. The slinger, being on the suction side, picks up the condensate by using the change in pressure across the fan which results in a higher liquid level in the low pressure, suction side. The slinger is wetted in contacting/passing through the condensate and the condensate which adheres due to surface tension is slung off due to centrifugal force. The air recirculating back from discharge side to the suction side tends to draw some of the condensate spray into the flowing air entering the fan resulting in continuous action on the condensate. The orifice lip encloses the fan and thereby prevents splashed condensate from coming out of the inlet. The inlet slinger slings the condensate against the hot condenser coil improving the condenser performance. The fan of the present invention is quieter due to better flow performance, better outflow conditions and better action on the condensate. Additionally, during shut down, with the pressure differential removed, the condensate moves away from the slinger thereby eliminating the "sloshing" sound heard in prior art discharge slinger designs.

It is an object of this invention to provide a low noise condenser fan.

It is another object of this invention to efficiently distribute condensate.

It is a further object of this invention to improve condenser side air flow performance. These objects, and others as will become apparent hereinafter, are accomplished by the present invention.

Basically, the pressure differential across an operating condenser fan acts on collected condensate to raise the level of the condensate on the suction side of the condenser fan. A rotating shroud located on the suction side of the fan rotor contacts and is wetted by the condensate with the condensate adhering due to surface tension. The rotating shroud acts as a slinger relative to the adhering condensate slinging the condensate by centrifugal action. At least some of the condensate is aspirated by the recirculating flow from the discharge to the suction side of the rotating shroud such that it passes through the fan rotor with the gas flow and is thrown against the condenser coil where the condensate evaporates while providing cooling to the condenser coil.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
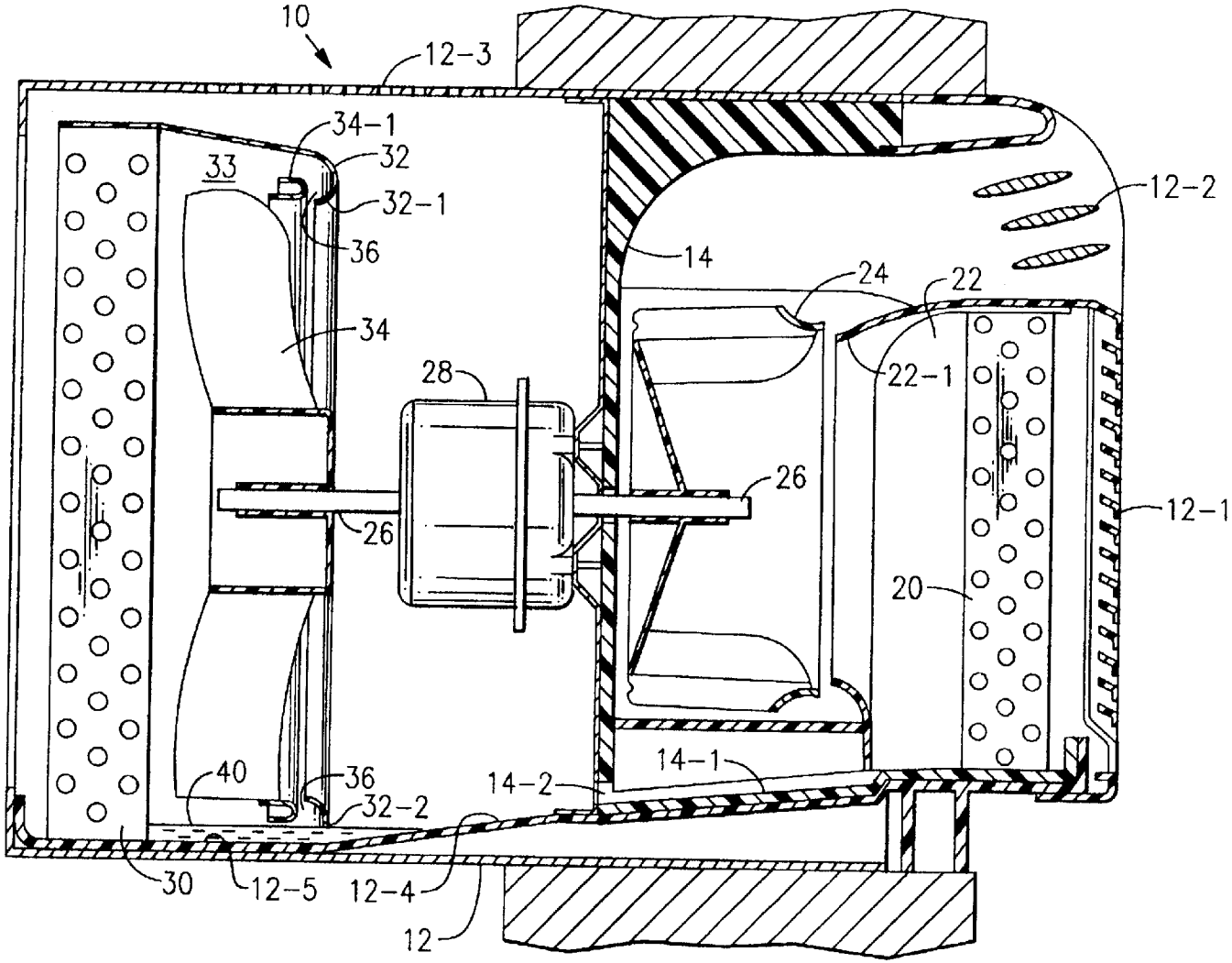
FIG. 1 is a vertical sectional view of the a room air conditioner employing the present invention.

In FIG. 1, the numeral 10 generally designates a room air conditioner employing the present invention. As is conventional, room air conditioner 10 has a housing 12 which may be located in a window or through the wall sleeve. Housing 12 is divided by partition or barrier 14 into an evaporator or inside section and a condenser or outside section which are each, in turn, divided into a suction and a discharge section relative to the fans located therein. Housing 12 includes inlet grill 12-1 which, when air conditioner 10 is installed, faces the interior of a room to be cooled. Evaporator 20 is located directly behind inlet grill 12-1 and is mounted within shroud or housing 22. Housing 22 has a central rear opening 22-1 connected to the inlet of evaporator fan 24. Fan 24 is driven by motor 28 via shaft 26 which passes through and is sealingly supported by partition 14. Evaporator fan 24 discharges into the room to be cooled via louvers 12-2. Condenser 30 is located in housing 12 with its discharge side facing the outside. Fixed shroud 32 is connected to condenser 30 and the interior of housing 12 such that a fan chamber 33 containing the moving portion of condenser fan 34 is formed. Fixed shroud 32 includes an inlet orifice 32-1. Fan 34 is of the axial, shrouded propeller type and is located entirely in the fan chamber 33 and is connected to motor 28 via shaft 26 such that both of fans 24 and 34 are commonly driven. Rotating shroud or suction slinger 34-1 is secured to the outer periphery of fan 34 on the inlet or suction side and extends towards inlet orifice 32-1 and coacts therewith to define the boundary between the suction side of fan 34 supplied via inlet grill 12-3 and the discharge side of condenser 30. Preferably the shroud 34-1 extends no more than 50% of the distance between suction and discharge, but a full shroud can be used in the practice of the present invention.

In operation, motor 28 commonly drives evaporator fan 24 and condenser fan 34. Evaporator fan 24 draws air from the room to be cooled with the air serially passing through inlet grill 12-1, evaporator 20 which causes the air to be cooled, fan 24 and louvers 12-2 back into the room. In cooling the air during its passage through evaporator 20, condensate commonly forms and falls to the bottom of the interior of partition 14 and housing 12 which include sloped sections 14-1 and 12-4, respectively, for causing the condensate to flow downwardly along sloped section 14-1 serially passing through condensate passage 14-2 in partition 14, along sloped section 12-4 and condensate passage 32-2 in fixed shroud 32-1 into condensate trough 12-5 where condensate 40 collects. Condenser fan 34 draws outside air into housing 12 via inlet grill 12-3 and the air serially passes through fan 34, and condenser 30 rejecting heat from the condenser.

Figure 2:
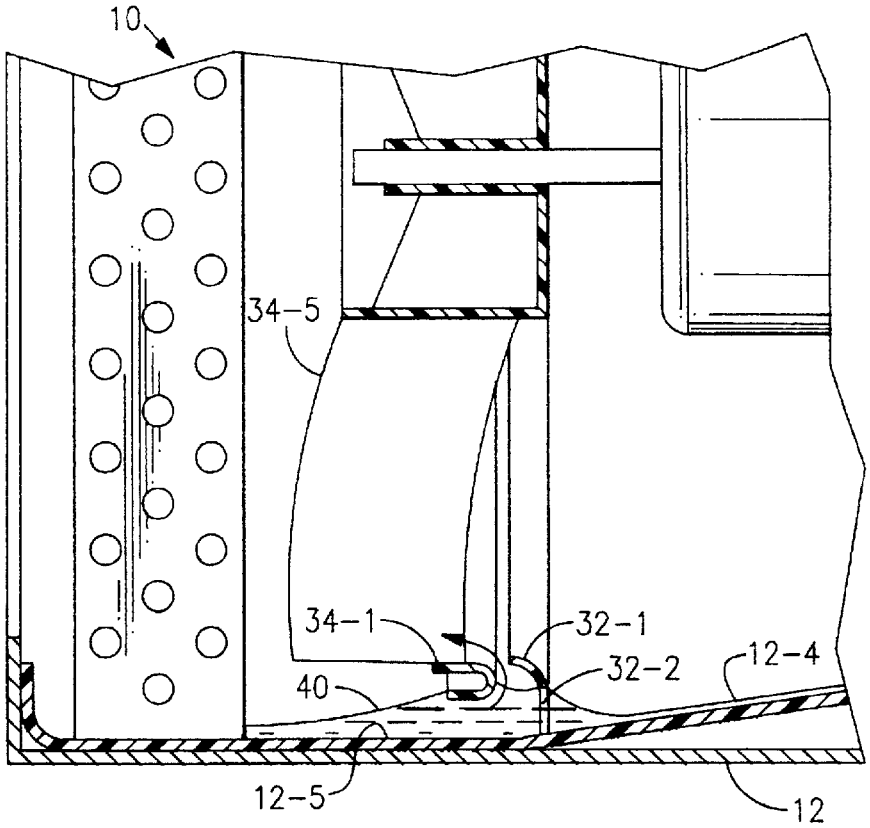
FIG. 2 is a partial, sectional view of the slinger structure of the present invention.
Figure 3:
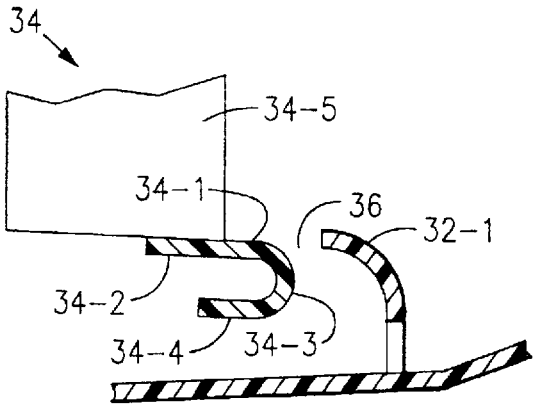
FIG. 3 is an enlarged view of a portion of FIG. 2.

The foregoing description is generally conventional except for the details relating to condensate disposal and to the uncovered discharge side of blades 34-5 permitting radial flow from fan 34. Referring specifically to FIGS. 2 and 3, it will be noted that condensate passage 32-2 is found in the periphery of shroud 32, as a notch or the like, at a location which is secured to sloped section 12-4 such that condensate 40 flowing downwardly along sloped section 12-4 readily flows through condensate passage 32-2 into condensate trough 12-5. Inlet orifice 32-1 and rotating shroud 34-1 are axially and radially spaced such that when fan 34 and its integral rotating shroud 34-1 are rotating, shroud 34-1 coacts with fixed shroud or inlet orifice 32-1 to establish a physical barrier in the nature of a narrow annular passage 36 separating the suction and discharge sides of condenser fan 34. The surface of the condensate 40 collecting in trough 12-5 is subjected to the discharge pressure produced by the operation of fan 34 and the condensate 40 tends to move towards the suction side producing a higher liquid level tending to move condensate 40 into the portion of annular passage 36 located near the bottom of housing 12. Referring specifically to FIG. 3, it will be noted that, in section, rotating shroud 34-1 is J-shaped with first, longer leg 34-2 being secured to the suction side of the tips of the blades 34-5 of fan 34. Second, shorter leg 34-4 is joined to first leg 34-2 by U-shaped curved portion 34-3. Leg 34-4 is located radially outward of leg 34-2 and is axially coextensive therewith for a distance corresponding to 10–30% of the axial depth (width as viewed in FIG. 3) of the tips of blades 34-5. Rotating shroud 34-1 is made of a material such as sheet metal or plastic such as polypropylene or styrene which is wetted by condensate with the condensate adhering due to surface tension.

There are three mechanisms acting to remove the collected condensate 40 from condensate trough 12-5. First, the pressure differential across the fan 34 tends to force the condensate 40 towards the suction side, as best shown in FIG. 2, and into annular passage 36. Since annular passage 36 is a suction zone and is, in part, defined by rotating shroud 34-1 the combination of agitation by the movement of shroud 34-1, the suction acting on annular passage 36, and the movement of air across passage 36 as it is drawn into fan 34 all combine to cause the aspiration of condensate 40 into the flow entering fan 34 if the condensate level is sufficiently high. Second, the leg 34-4 of rotating shroud 34-1 extends into the condensate near the suction side which is the location of greatest condensate depth during operation. The leg 34-4 and curved portion 34-3 of shroud 34-1 act as a pump relative to condensate 40 slinging the adhering condensate outward and against the condenser 30. Third, some condensate may recirculate through annular gap 36 at other azimuthal locations of the fan. That portion of condensate which recirculates flows through the fan.

Figure 4:
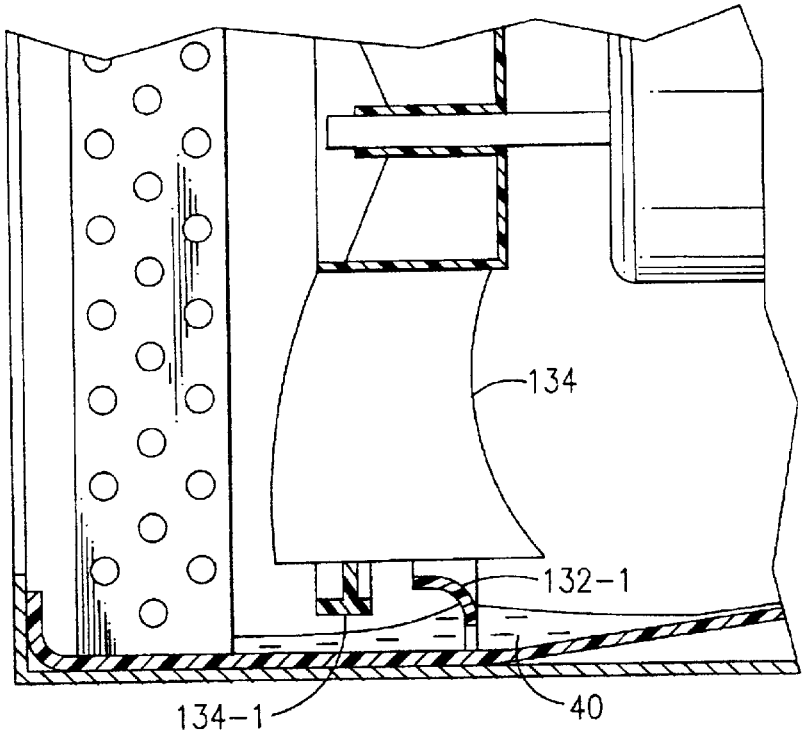
FIG.4 Prior Art
FIG. 4 is a partial, sectional view of a prior art slinger structure.

FIG. 4 illustrates a PRIOR ART slinger arrangement. Initially it will be noted that rotating shroud 134-1 is axially spaced, in a downstream direction, from inlet orifice 132-1 so that rotating shroud 134-1 is entirely in the discharge pressure region and does not contact the condensate 40 at its deepest/highest location. Because the shroud 134-1 acts on the condensate 40 in a region acted on by discharge pressure, the condensate 40 will have to build up to a higher level for the shroud 134-1 to contact condensate 40, as compared to shroud 34-1. Additionally, all condensate taken up by rotating shroud 134-1 is thrown into the flow discharged by the fan 134 rather than having at least a portion passing through the fan and being dispersed according to the teachings of the present invention.

Figure 5:
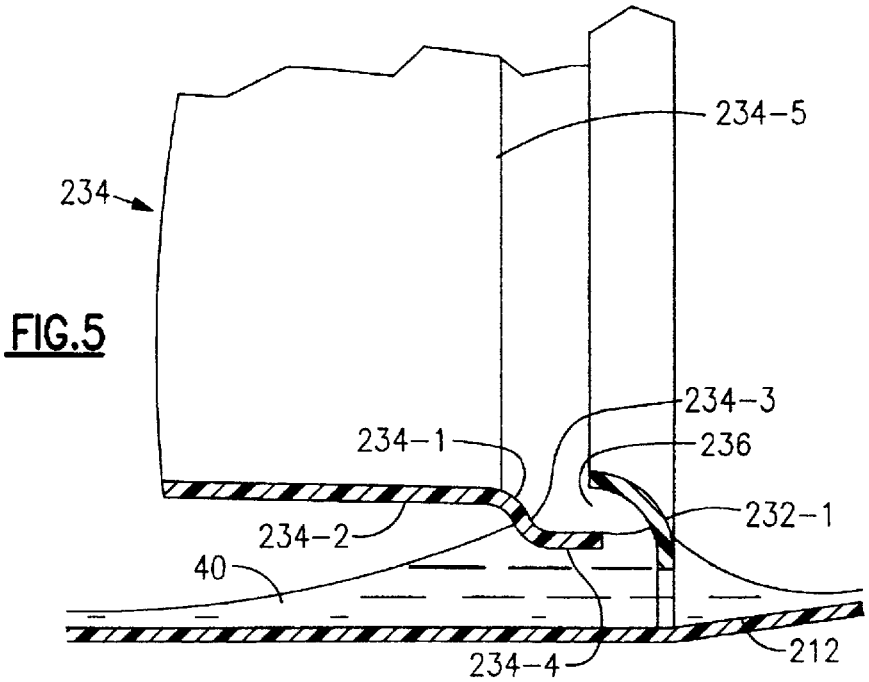
FIG. 5 is a vertical sectional view of a second embodiment of the present invention.
Figure 6:
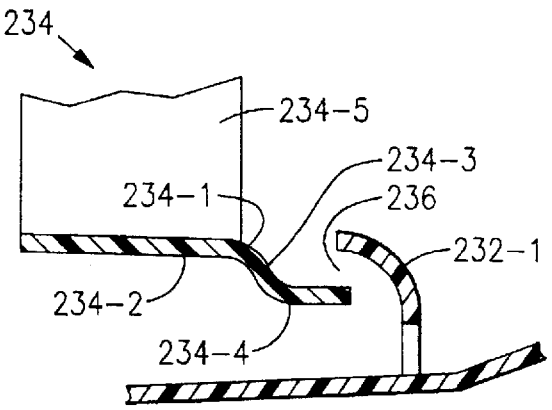
FIG. 6 is an enlarged view of a portion of FIG. 5.

Referring now to FIGS. 5 and 6, a modified rotating shroud 234-1 is disclosed which differs from rotating shroud 34-1 of FIGS. 1–3 in that shroud 34-1 is J-shaped, in section, whereas shroud 234-1 is a stylized Z-shape, in section, with the two legs being offset with respect to each other. Specifically, inner axially extending annular portion 234-2 is secured to the outer tips of the blades 234-5 of fan 234 and appears as a first leg of a stylized Z in section. Outer axially extending annular portion 234-4 is radially outward and axially forward of annular portion 234-2 and appears as a second leg of a stylized Z in section. The annular, generally radially extending portion 234-3 connects portions 234-2 and 234-4. Annular portion 234-2 is illustrated as extending for the fall axial extent of blades 234-5, but may be shorter. As noted above three. mechanisms for condensate removal and a larger/longer annular portion can be employed if necessary, or desired.

As in the case of shroud 341, shroud 234-1 coacts with inlet orifice 232-1 to define narrow annular passage 236 which is a physical barrier separating the suction and discharge sides of condenser fan 234. As is best shown in FIG. 5, the surface of the collected condensate 40 is subjected to the pressure differential across fan 234, so the condensate 40 tends to move towards the suction side producing a higher liquid level tending to move condensate 40 into the portion of passage 236 located near the bottom of housing 212.

A number of factors act to remove the collected condensate from housing 212. First, the pump structure defined by portions 234-2 and 234-3 of rotating shroud 234-1 acts to throw the adhering condensate radially outward. Second, some of the spray thrown off from the pump structure at the discharge side tends to recirculate via annular passage 236 into the suction side of fan 234. Third, some of the collected condensate 40 is directly drawn into the fan via annular passage 236 if the condensate level is sufficiently high.

Figure 7:
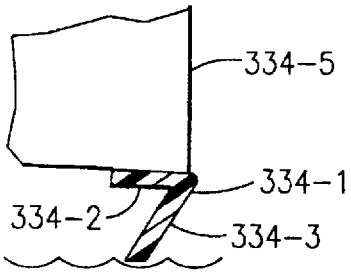
FIG. 7 is a vertical section of a third embodiment of the present invention.
Figure 8:
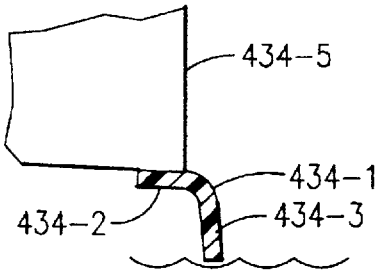
FIG. 8 is a vertical section of a fourth embodiment of the present invention.
Figure 9:
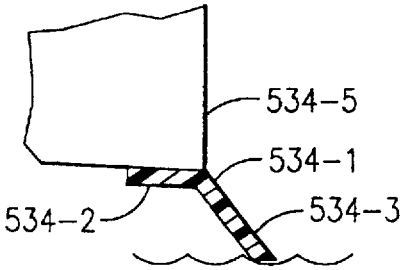
FIG. 9 is a vertical section of a fifth embodiment of the present invention.

FIGS. 7–9 illustrate modified rotating shrouds 334-1, 434-1 and 534-1, respectively, having axially extending annular portions 334-2, 434-2, and 534-2, respectively, secured to the suction side of the outer tips of the blades 334-5, 434-5, and 534-5, respectfully. Rotating shrouds 334-1, 434-1, and 534-1 differ from each other in that they have generally radially outward extending portion 334-3, 434-3, and 534-3, defining included angles of nominally 60°, 90° and 120° with annular portion 334-2, 434-2, and 534-2, respectively.

In general, the shape of the rotating shroud is only important as to how it coacts with the inlet orifice and the condensate. Specifically, as to the condensate, the main concern is the condensate level at which contact is made and the area of contact between the rotating shroud and the condensate. The coaction between the rotating shroud and inlet orifice must be such as to define a boundary between suction and discharge.

Figure 10:
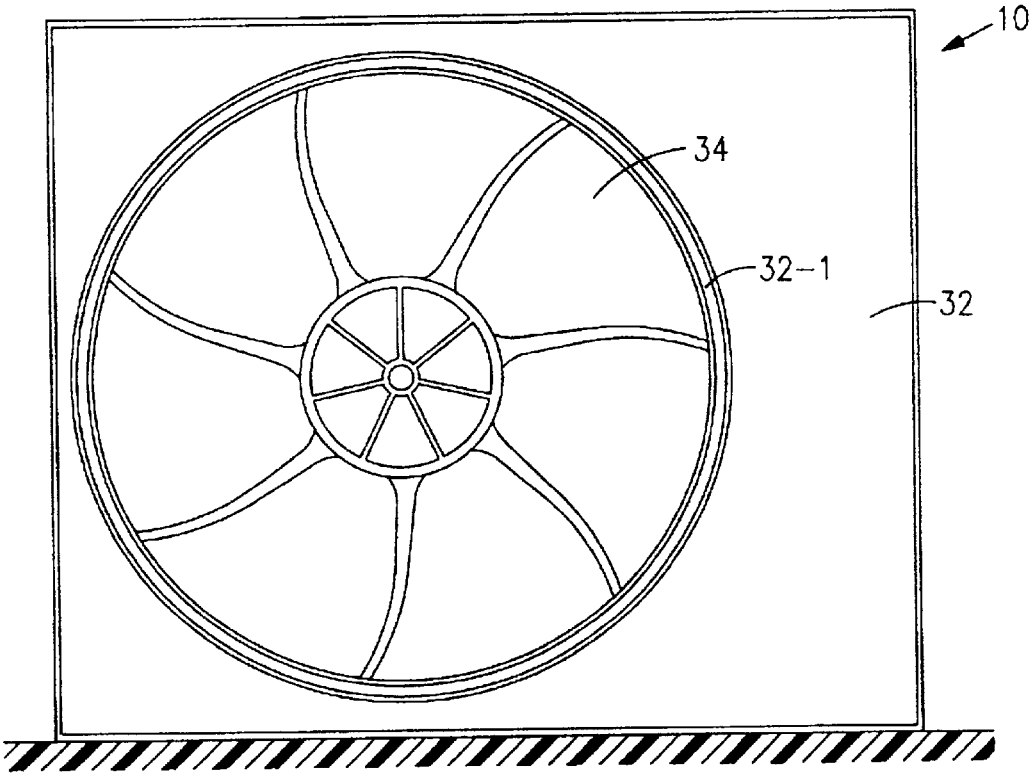
FIG. 10 is an end view of the entrance to the condenser fan of all embodiments.

FIG. 10 is applicable to the embodiments of FIGS. 1 to 3 and 4 and of FIGS. 5 to 9 but is labeled specifically for the embodiment of FIGS. 1 to 3. In each embodiment condensate is delivered to the suction flow entering the fan by the rotating shroud 34-1, 234-1, 334-1, 434-1 or 534-1.

Although preferred embodiments of the present invention have been illustrated and described, other modifications will occur to those skilled in the art. It is therefore intended that the present invention is to be limited only by the scope of the appended claims.

What is claimed is:

1. In an air conditioning unit having a condenser, a condenser fan having a suction side and a discharge side located upstream of said condenser, means for collecting condensate located at least partially intermediate said condenser and said condenser fan in said discharge side, means for disposing of said collected condensate comprising:

said condenser fan being an axial fan with a plurality of blades having tips extending from said suction side to said discharge side;

means for rotatably driving said fan;

an annular slinger surrounding and having a portion secured to said blade tips in a region extending from said suction side for at least a portion of the distance to said discharge side;

a fixed shroud including an inlet orifice;

said tips and said slinger being located entirely within said fixed shroud;

said inlet orifice and said slinger coacting to define a restricted passage extending between said suction side and said discharge side;

said slinger having means for contacting said collected condensate and being wetted thereby such that said collected condensate tends to adhere to said slinger whereby when said unit is operating and said fan and slinger rotate as a unit, a pressure differential across said fan acts on said collected condensate tending to cause said collected condensate to move towards and to be at a higher level towards said suction side and said slinger contacts said higher level of collected condensate and is wetted thereby with adhering condensate being slung by centrifugal force into air discharging from said blades.

2. In an air conditioning unit having a condenser, a condenser fan having a suction side and a discharge side located upstream of said condenser, means for rotating said fan, means for collecting condensate located at least partially intermediate said condenser and said condenser fan in said discharge side, means for disposing of said collected condensate comprising:

said condenser fan being an axial fan with a plurality of blades having tips extending from said suction side to said discharge side;

means for rotatably driving said fan;

an annular slinger surrounding and having a portion secured to said blade tips in a region extending from said suction side for at least a portion of the distance to said discharge side;

a fixed shroud including an inlet orifice;

said inlet orifice and said slinger coacting to define a restricted passage extending between said suction side and said discharge side;

said slinger having means for contacting said collected condensate and being wetted thereby such that said collected condensate tends to adhere to said slinger whereby when said unit is operating and said fan and slinger rotate as a unit, a pressure differential across said fan acts on said collected condensate tending to cause said collected condensate to move towards and to be at a higher level towards said suction side and said slinger contacts said higher level of collected condensate and is wetted thereby with adhering condensate being slung by centrifugal force into air discharging fron said blades;

said annular slinger having a first axially extending annular portion which is said portion secured to said blade tips, a second axially extending annular portion radially outwardly spaced from said first axially extending annular portion and axially coextensive therewith for at least a portion of said first axially extending annular portion, and a third portion joining said first and second axially extending annular portions.

3. The means for disposing of said collected condensate of claim 2 further comprising:

said third portion facing said inlet orifice and coacting therewith to at least partially define said restricted passage.

4. The means for disposing of said collected condensate of claim 3 further comprising:

said third portion and said second axially extending annular portion being said means for contacting said collected condensate and slinging said adhering condensate into air discharging from said blades.

5. The means for disposing of said collected condensate of claim 4 further comprising:

said third portion rotating with respect to said inlet orifice agitating said collected condensate and tending to cause the aspiration of said collected condensate into air flowing into said fan.

6. The means for disposing of said collected condensate of claim 3 further comprising:

said third portion rotating with respect to said inlet orifice agitating said collected condensate and tending to cause the aspiration of said collected condensate into air flowing into said fan.

7. The means for disposing of said collected condensate of claim 2 further comprising:

said third portion and said second axially extending annular portion being said means for contacting said collected condensate and slinging said adhering condensate into air discharging from said blades.

8. The means for disposing of said collected condensate of claim 1 further comprising:

said annular slinger having a first axially extending annular portion which is said portion secured to said blade tips, a second axially extending annular portion extending from said fan towards said suction side and being of a larger diameter than said first portion, and a third portion joining said first and second portions.

9. The means for disposing of said collected condensate of claim 8 further comprising:

said second portion being radially outwardly spaced from and axially extensive with a portion of said inlet orifice whereby at least a portion of said restricted passage is defined.

10. The means for disposing of said collected condensate of claim 9 further comprising:

said second and third portions being said means for contacting said collected condensate and for slinging said adhering condensate into air discharging from said blades.

11. The means for disposing of said collected condensate of claim 10 further comprising:

the outermost surface of said third portion contacting said collected condensate and tending to sling condensate adhering thereto into air discharging from said blades.

12. The means for disposing of said collected condensate of claim 9 further comprising:

the outermost surface of said third portion contacting said collected condensate and tending to sling condensate adhering thereto into air discharging from said blades.

13. The means for disposing of said collected condensate of claim 1 further comprising:

said annular slinger having a first axially extending annular portion which is said portion secured to said blade tips and second generally radially outwardly extending annular portion.

14. The means for disposing of said collected condensate of claim 13 wherein said second annular portion is said means for contacting said collected condensate and slinging said adhering condensate into air discharging from said blades.

15. In an air conditioning unit having a condenser, a condenser fan having a suction side and a discharge side located upstream of said condenser, means for collecting condensate located at least partially intermediate said condenser and said condenser fan in said discharge side, means for disposing of said collected condensate comprising:

said condenser fan being an axial fan with a plurality of blades having tips extending from said suction side to said discharge side;

an annular slinger surrounding and having a first portion secured to said blade tips in a region extending from said suction side for at least a portion of the distance to said discharge side;

said annular slinger having a second portion radially outwardly spaced from said first portion and axially coextensive therewith for at least a portion of said first portion, and a third portion joining said first and second portions;

a fixed shroud including an inlet orifice;

said tips and said slinger being located entirely within said fixed shroud;

said inlet orifice and said slinger coacting to define a restricted passage extending between said suction side and said discharge side;

said slinger having means for contacting said collected condensate and being wetted thereby such that said condensate tends to adhere to said slinger;

said third portion and said second portion being said means for contacting said collected condensate and slinging said adhering condensate into air discharging from said blades;

whereby when said unit is operating, discharge pressure in said discharge side acts on said collected condensate tending to cause said collected condensate to be at a higher level towards said suction side and to pass into said restricted passage and said slinger contacts said collected condensate and is wetted thereby and centrifugal force causes a portion of said adhering condensate to be slung into air discharging from said blades.

16. The means for disposing of said collected condensate of claim 15 further comprising:

said third portion facing said inlet orifice and coacting therewith to least partially define said restricted passage.

17. The means for disposing of said collected condensate of claim 16 further comprising:

said third portion rotating with respect to said inlet orifice agitating said collected condensate and tending to cause the aspiration of said collected condensate into air flowing into said fan.

* * * * *